US006364224B1

(12) United States Patent
Pearce

(10) Patent No.: US 6,364,224 B1
(45) **Date of Patent: *Apr. 2, 2002**

(54) DRYING SUSPENSIONS OF MATERIALS

(75) Inventor: David Anthony Pearce, Cornwall (GB)

(73) Assignee: ECC International Limited, Reading (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/081,920

(22) Filed: May 20, 1998

Related U.S. Application Data

(63) Continuation-in-part of application No. 08/435,587, filed on May 5, 1995, now abandoned.

(30) Foreign Application Priority Data

May 6, 1994 (GB) ..... 94303280

(51) Int. Cl.[7] ..... B02C 17/16

(52) U.S. Cl. ..... 241/16; 241/21; 241/23; 241/30

(58) Field of Search ..... 241/16, 23, 21, 241/30

(56) References Cited

U.S. PATENT DOCUMENTS

| | | | |
|---|---|---|---|
| 3,643,800 A | 2/1972 | Manson | |
| 4,370,198 A | 1/1983 | Dencs et al. | |
| 4,673,134 A | 6/1987 | Barthelmess | |
| 5,092,527 A | 3/1992 | Perrg et al. | |

FOREIGN PATENT DOCUMENTS

| | | |
|---|---|---|
| EP | 0 141 509 | 5/1985 |
| EP | 0 211 547 | 2/1987 |
| EP | 0 289 916 | 11/1988 |
| EP | 0 343 817 | 5/1989 |
| EP | 0 510 890 | 10/1992 |
| FR | 2 255 559 | 7/1975 |
| GB | 1 449 718 | 9/1976 |
| GB | 2 209 384 | 5/1989 |
| JP | 2 065 729 | 3/1987 |
| JP | 6 327 991 | 11/1994 |
| WO | WO 80/01407 | 7/1980 |

*Primary Examiner*—Mark Rosenbaum
(74) *Attorney, Agent, or Firm*—Klauber & Jackson

(57) ABSTRACT

An apparatus and a process for drying a suspension of a finely divided particulate solid material to produce the solid material in a substantially dry and unagglomerated form. The apparatus consists of a grinding chamber containing a particulate grinding medium such as silica having a diameter of 1–5 mm, a conduit for introducing the suspension into the grinding chamber and an impeller which rotates in the grinding chamber. The grinding chamber has a perforated base through which a heated gas is introduced to provide an upward flow of gas through the grinding chamber and through the grinding medium. As the particulate material is dried, fine particles of the dried material are carried upwards in the upflow of gas through the grinding chamber. A filter such as one or more cyclones and/or a bag filter assembly is located downstream of the grinding chamber in order to separate the particles of dried material from the gas.

17 Claims, 1 Drawing Sheet

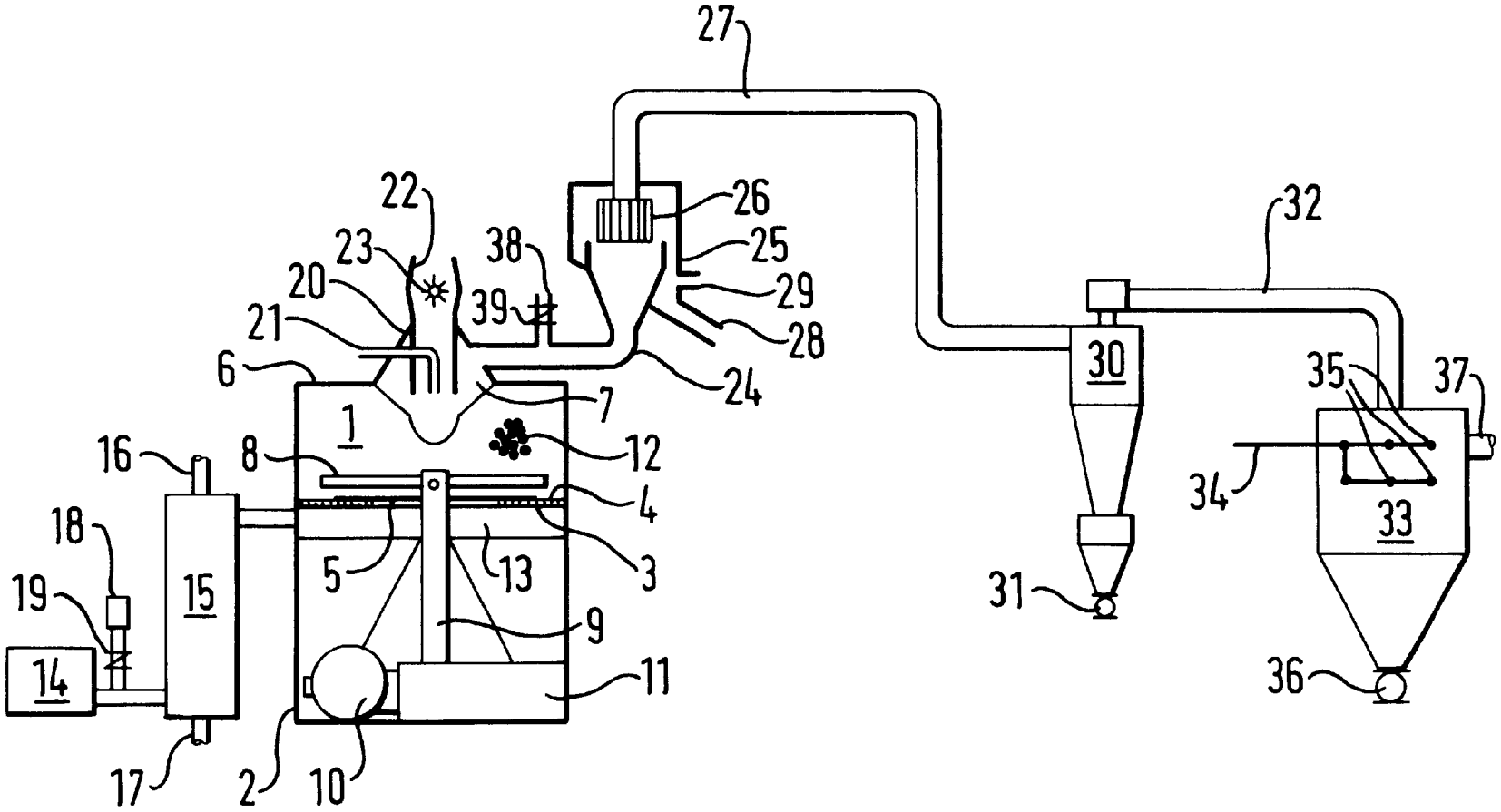
37
33
35
36
32
34
30
31
27
26
25
29
28
24
12
4
3
11
7
9
38
39
13
22
23
20
21
1
5
10
6
8
2
15
16
17
18
19
14

DRYING SUSPENSIONS OF MATERIALS

CROSS-REFERENCE TO RELATED APPLICATIONS

This application is a continuation-in-part of application Ser. No. 08/435,587 filed May 5, 1995 and now abandoned, which application claims the foreign priority of U.K. application serial no. 94303280.5 filed May 6, 1994.

FIELD OF THE INVENTION

The invention pertains to a process and apparatus for drying suspensions of particulate solid materials.

BACKGROUND OF THE INVENTION

Many different types of apparatus are available for thermal drying of wet particulate materials, but most suffer from the disadvantage that the particles tend to agglomerate during the drying process and the particle size distribution of the dry product tends to be significantly coarser than that of the wet feed material. The problem is particularly evident when the particulate material is finely divided, for example when it has a particle size distribution such that more than about 60% by weight consists of particles having an equivalent spherical diameter smaller than 2 $\mu$m, and when the particulate material is highly concentrated in the aqueous medium, for example when the solids content of the suspension is in excess of about 50% by weight. For this reason, many finely divided particulate materials are made available commercially in the form of concentrated aqueous suspensions, and it is not commercially attractive to produce them in the form of a dried powder.

For many end uses, and especially when the particulate material is to be dispersed in a non-aqueous or non-polar medium, such as, for example, when it is to be used as a filler or extender in an organic polymer composition such as a rubber, plastics or non-aqueous paint composition, a finely divided particulate material in dry powder form would be commercially and technologically advantageous.

Transporting a particulate material in aqueous suspension form has the obvious disadvantage that a significant quantity of water is associated with the particulate material, which adds to the cost of conveying the material.

SUMMARY OF THE INVENTION

According to a first aspect of the present invention, there is provided an apparatus for drying a suspension of a finely divided particulate solid material in an aqueous or non-aqueous medium to thereby produce a substantially dry product, comprising:

(a) a grinding chamber containing a particulate grinding medium, said grinding chamber having an inner wall and a perforated base through which a heated gas is introduced to provide an upflow of gas through the grinding chamber and through the grinding medium, said perforated base having a central imperforate area which causes the gas to pass preferentially through a region near the walls of the grinding chamber;

(b) means for introducing the suspension into the grinding chamber; and (c) an impeller capable of rotation in the grinding chamber, said impeller being provided with impeller bars.

The gas to be introduced through the perforated base of the grinding chamber is advantageously compressed by means of a fan and may be heated indirectly by passage through one side of a heat exchanger, or directly by contact with electric heating elements, or by passage through a combustion chamber in which a gaseous, liquid or solid fuel is burned.

The perforated base of the grinding chamber preferably has a central imperforate area which causes the gas to pass preferentially through the region near the walls of the grinding chamber. A top plate having a central opening is preferably positioned in the grinding chamber at a height above the perforated base which is not greater than one half of the diameter of the grinding chamber. The top plate is provided to prevent a bed of particulate solid material in the grinding chamber from extending upwards to an undesirable degree near the walls of the grinding chamber.

Classifying means for separating the substantially dry product into fractions of different particle sizes is preferably provided downstream of the grinding chamber. The classifying means may be separate from the grinding chamber and connected thereto by suitable conduits or may be mounted above the grinding chamber and may form an integral part therewith. The classifying means may conveniently be of the type in which a cylindrical or frusto-conical cage, comprising peripheral, longitudinally extending blades or vanes, is rotated about its longitudinal axis in a current of a suspension of particles in a gas. Relatively fine particles in the suspension pass between the blades or vanes of the rotating cage, while relatively coarse particles are deflected by the blades or vanes in the radially outward direction of the cage.

Advantageously, means are provided to inject additional gas into the mixture of gas and particles between the grinding chamber and the classifying means or into the classifying means itself. This arrangement makes it possible to adjust the flow rate of gas through the grinding chamber independently of the flow rate of gas through the classifying means, with the result that conditions in the grinding chamber can be adjusted to give an optimum product which will enable the classifying means to operate with the greatest precision and efficiency. Advantageously, a suction fan is provided downstream of the classifying means to provide negative pressure which will draw gas and suspended particles at the desired rate through the classifying means.

Filter means are also preferably provided downstream of the grinding chamber, (and of the classifying means, if used) to separate solid particles from the suspending gas. These means may be, for example, one or more cyclones and/or a bag filter assembly.

According to a second aspect of the invention, a process is provided for drying a suspension of a finely divided particulate solid material in an aqueous or non-aqueous medium to thereby produce a substantially dry product, comprising the steps of:

(a) introducing the suspension into a grinding chamber containing a bed of particulate grinding medium;

(b) rotating an impeller provided with impeller bars present in the grinding chamber so as to agitate the grinding medium; and (c) introducing a heated gas through a perforate base of the grinding chamber such that it passes through the bed of the grinding medium, said substantially dry product being entrained by the gas and conveyed out of the grinding chamber.

Preferably, in practicing the process of the invention, the impeller will rotate in the grinding chamber at a peripheral speed in the range of about 5 to 20 $m.s^{-1}$, especially 8 to 11 $m.s.^{-1}$. Advantageously, the impeller will have a diameter d such that a gap in the range of about 0.01 d to 0.05 d is present between the ends of the impeller bars and the inner wall of the grinding chamber.

DETAILED DESCRIPTION OF THE INVENTION

The grinding medium preferably comprises particles of diameter within the range from 0.5 to 12.5 mm. More preferably, the grinding medium comprises particles of diameter within the range from 1.0 to 5.0 mm. The grinding medium may comprise balls, beads or pellets of any hard mineral, ceramic or metallic material. Alternatively, particles of natural sand of appropriate size have been found to be very effective.

The process of the invention is particularly advantageous when the particulate solid material has a particle size distribution such that at least 60% by weight consists of particles having an equivalent spherical diameter smaller than 2 $\mu$m. The suspension of the solid material is preferably a concentrated aqueous suspension and the process is particularly advantageous when the suspension has a solids content in excess of about 50% by weight, based on the weight of the suspension.

The suspension may be fluid and of relatively low viscosity, in which case a dispersing agent would generally be used. The dispersing agent may be, for example, a water soluble condensed phosphate, a water soluble salt of a polysilicic acid or a polyelectrolyte, for example a water soluble salt of a poly(acrylic acid) or of a poly(methacrylic acid) having a number average molecular weight not greater than 20,000. The amount of the dispersing agent used would generally be in the range of from 0.1 to 2.0% by weight, based on the weight of the dry particulate solid material. The suspension may be introduced at a temperature within the range from about 4° C. to about 100° C. However, it is advantageous to pre-heat the suspension to a temperature within the range from 25° C. to 100° C. Alternatively, the suspension may be in the form of a cake such as is formed in high pressure filtration of a relatively dilute suspension of the particulate solid material, provided that the cake is non-sticky. If the suspension is of the fluid type, it may be introduced into the grinding chamber through a conduit provided with a suitable inlet nozzle. If the suspension is in the form of a cake, it may be introduced through suitable ducting, the grinding chamber end of which may be closed by a rotating valve to prevent gas from passing from the grinding chamber into the ducting.

The gas containing entrained particles leaving the grinding chamber is preferably passed through dry classifying means to remove any particles having diameters greater than the desired maximum particle size. Generally it is required that the substantially dry product is free of any particles having an equivalent spherical diameter greater than 10 $\mu$m, and the dry product is preferably free of any particles having an equivalent spherical diameter greater than 5 $\mu$m.

The gas passing through the perforated base of the grinding chamber preferably has a temperature such that the temperature of the gas and suspended particles leaving the grinding chamber is at least 70° C. It has also been found that a classifying means will not provide efficient separation if the gas which carries the particles to be separated is bone dry. Generally, for most efficient separation, it is required that the gas entering the classifying means has a relative humidity of at least 15%, but the relative humidity of the gas must not be so high as to cause condensation in later stages of the process. Generally the relative humidity of the gas should not be greater than about 55%. The particulate material is preferably dried to a water content of not more than 1% by weight, and preferably to a water content of not more than 0.2% by weight.

The fine particulate material which is dried in the grinding chamber may, at the same time be coated with a surface treatment agent which is conveniently introduced into the grinding chamber in particulate solid form through a duct which is provided at its grinding chamber end with a rotary valve. The surface treatment agent may be, for example, a fatty acid having from 12 to 24 carbon atoms in its hydrocarbon chain. Alternatively a liquid surface treatment agent may be used, such as a substituted silane substituted with at least one group having hydrophobic properties and at least one group which is compatible with the surface of the particulate solid material to be treated. Most suitably the substituted silane is of the type which is represented by the general formula:

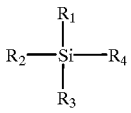

where $R_1$ is an aminoalkyl or mercaptoalkyl group, $R_2$ is a hydroxy, hydroxyalkyl or alkoxy group, and each of $R_3$ and $R_4$, which may be the same or different, is a hydrogen atom or a hydroxy, alkyl, hydroxyalkyl or alkoxy group.

BRIEF DESCRIPTION OF DRAWING

The accompanying drawing is a diagrammatic representation of the apparatus of the invention.

DETAILED DESCRIPTION OF THE DRAWING

A grinding chamber 1 is defined by a casing 2, a base plate 3, which has a peripheral annular perforated area 4 and a central imperforate area 5 and a top plate 6, the height of which above base plate 3 is not greater than one half of the diameter of grinding chamber 1, and which is provided with a central aperture 7. An impeller consisting of four cylindrical impeller bars 8 secured to a vertical shaft 9 rotates in a horizontal plane a small vertical distance above base plate 3. Shaft 9 has a diameter d such that a gap in the range of about 0.01 d to 0.05 d is present between the ends of impeller bars 8 and the inner wall of grinding chamber 1.

The impeller is driven by an electric motor 10 through a gear box 11 advantageously at a peripheral speed of about 5 to 20 $m.s^{-1}$, preferably 8 to 11 $m.s^{-1}$. The grinding chamber is charged with a grinding medium 12 which conveniently consists of grains of silica sand having diameters in the range of about 0.5 to 12.5 mm, preferably from 1 mm to 5 mm.

Heated air under pressure is introduced into a plenum chamber 13 immediately below base plate 3 by means of a fan 14. Compressed air is blown into plenum chamber 13 through a heat exchanger 15, to which hot gas is admitted through an inlet 16, and from which it is exhausted through an outlet 17. The volume of heated air entering plenum chamber 13 may be adjusted by admitting additional air through a vent 18, the volume of air entering in this way being controlled by means of a valve 19.

Central aperture 7 of top plate 6 of grinding chamber 1 is covered with a frusto-conical hood 20. An aqueous suspension of a particulate material to be dried is introduced into the grinding chamber through a conduit 21 which passes through the side of this hood. An inlet duct 22 for charging solid materials into the grinding chamber passes through the top of the hood and is provided with a rotary valve arrangement 23 which seals the interior of grinding chamber 1 from the exterior. Solid surface treatment agents may be introduced into the grinding chamber through duct 22. Alternatively, if the suspension of particulate material to be dried is in the form of a substantially non-sticky cake, this may be introduced through duct 22.

Air containing entrained substantially dry fine particles leaves grinding chamber 1 through a duct 24 which leads to an air classifier 25. Air classifier 25 comprises a rotating cage 26 made up of peripheral bars or vanes. Of the particles entrained in the air, those of sufficient fineness pass between the bars of rotating cage 26, and are discharged from the classifier through a duct 27, while any undesirably coarse particles present in the air stream are deflected by the bars of rotating cage 26 and are thrown to the outer wall of classifier 25 to be discharged through a chute 28 to be discarded or recycled to grinding chamber 1. Generally not more than about 5% by weight of the particles entering classifier 1 are discharged as the coarse fraction.

The stream of air containing entrained fine particles passes through duct 27 to a cyclone 30 which separates the fine particles from the air, the fine particles being discharged as product through a rotary valve arrangement 31 at the base of cyclone 30. Air which is almost completely freed from entrained fine particles passes through a duct 32 to a bag filter assembly 33 where the remaining finely divided material is separated from the air. Pulses of high pressure air are supplied through a conduit 34 to a plurality of inlets 35 communicating with the interior of filter stockings (not shown) in the bag filter to blow accumulated solid material off the outer surface of the filter stockings. The solid material falls to the base of bag filter assembly 33 whence it is discharged through a rotary valve 36. Substantially clean air leaves through an outlet 37.

The particle size distribution of the fine particles leaving air classifier 25 may be controlled by adjusting the speed of rotation of cage 26 and the volumetric flow rate of air and entrained particles through classifier 25. For this latter purpose, additional air may be drawn into the stream entering classifier 25 through an inlet 38, the flow of air being controlled by means of a valve 39. Alternatively, the additional air may be drawn through an inlet 29 provided in the casing of air classifier 25. The intake of air at one of these points is assisted by providing a reduced pressure in the bag filter assembly by means of a fan 40 which is connected to outlet 37 of bag filter assembly 33.

The invention will now be described with reference to the following example.

EXAMPLE 1

A suspension containing 78% by weight of a natural marble which had been comminuted to give a product having a particle size distribution such that 90% by weight consisted of particles having an equivalent spherical diameter smaller than 2 $\mu$m was introduced through the inlet conduit 21 of a drying apparatus of the type illustrated in the Figure. The suspension also contained 0.7% by weight, based on the weight of dry marble, of a sodium polyacrylate dispersing agent.

The final product was found to contain 0.1% by weight of water. This product was tested for percentage reflectance to light of wavelength 457 nm and 570 nm, respectively, according to the procedure laid down in International Standard No. I.S.O. 2470. The product was also tested for the percentages by weight of the particles which had equivalent spherical diameters larger than 53 $\mu$m, larger than 10 $\mu$m, smaller than 2 $\mu$m and smaller than 1 $\mu$m, respectively. The size of the largest particles in the product after dispersion to break down any agglomerates present was also determined by means of a Hegman gauge. As a comparison, a sample of the feed material was also subjected to the same tests.

The results obtained are set forth in Table 1 below:

TABLE 1

| | % reflectance to light of wavelength | | % by weight | | | | Hegman gauge reading |
|---|---|---|---|---|---|---|---|
| Product Source | 457 nm | 570 nm | larger than 53 $\mu$m | larger than 10 $\mu$m | smaller than 2 $\mu$m | smaller than 1 $\mu$m | ($\mu$m) |
| Feed Suspension | 94.0 | 95.0 | 0.013 | 0.3 | 87 | 61 | — |
| Dry Product | 94.1 | 95.0 | 0.013 | 0.1 | 87 | 60 | 5 |

What is claimed is:

1. A process for drying a suspension of a finely divided particulate solid material in an aqueous or non-aqueous medium to thereby produce a substantially dry product, comprising the steps of:

(a) introducing the suspension into a grinding chamber containing a bed of particulate grinding media disposed upon a perforated base having an outer annular perforated area and a central imperforate area;

(b) agitating the grinding media in the grinding chamber by rotating an impeller therein provided with impeller bars the distal ends of which are spaced from the internal walls of the said chamber; and (c) introducing an upflow of heated gas through said perforate base of the grinding chamber such that it passes through the bed of the grinding media, the said disposition of said imperforate and perforate portions of said base causing said gas to flow preferentially through the annular region abounding the walls of the grinding chamber; and the substantially dry product being entrained by the gas and conveyed out of the grinding chamber.

2. A process as claimed in claim 1, in which the impeller rotates in the grinding chamber at a peripheral speed in the range of about 5 to 20 $ms^{-1}$.

3. A process as claimed in claim 2, in which the peripheral speed in the range of 8 to 11 $ms^{-1}$.

4. A process as claimed in claim 1, in which the impeller has a diameter d such that a gap in the range of about 0.1 d to 0.05 d is present between the ends of the impeller bars and the inner wall of the grinding chamber.

5. A process as claimed in claim 1, in which the grinding medium comprises particles having a diameter in the range of about 0.5 to 12.5 mm.

6. A process as claimed in claim 5, in which the particles have a diameter in the range of 1.0 to 5.0 mm.

7. A process as claimed in claim 1, in which the finely divided particulate solid material has a particle size range distribution such that more than about 60% by weight consists of particles having an equivalent spherical 5 diameter smaller than 2 $\mu$m.

8. A process as claimed in claim 1, in which the suspension has a solids content in excess of about 50% by weight, based on the weight of the suspension.

9. A process as claimed in claim 1, further comprising the step of adding a dispersing agent to the suspension prior to introduction of the suspension into the grinding chamber.

10. A process as claimed in claim 1, in which the suspension is preheated to a temperature in the range of about 25 to 100° C. prior to introduction of the suspension into the grinding chamber.

11. A process as claimed in claim 1, further comprising the step of adding a surface treatment agent to the suspension in the grinding chamber.

12. A process for drying a suspension of a finely divided particulate solid material in an aqueous or non-aqueous medium to thereby produce a substantially dry product, comprising the steps of:

(a) introducing a said suspension having a particle size range distribution such that more than about 60% by weight consists of particles having an equivalent spherical diameter smaller than 2 $\mu$m into a grinding chamber containing a bed of particulate grinding media disposed upon a perforated base having an outer annular perforated area and a central imperforate area;

(b) agitating the grinding media in the grinding chamber by rotating an impeller therein provided with impeller bars the distal ends of which are spaced from the internal walls of the said chamber; and p1 (c) introducing an upflow of heated gas through said perforate base of the grinding chamber such that it passes through the bed of the grinding media, the said disposition of said imperforate and perforate portions of said base causing said gas to flow preferentially through the annular region abounding the walls of the grinding chamber; and the substantially dry product being entrained by the gas and conveyed out of the grinding chamber.

13. A process in accordance with claim 12, wherein said suspension has a solids content in excess of about 50% by weight based on the weight of the suspension.

14. A process in accordance with claim 12, wherein said grinding media comprises particles having a diameter in the range of 0.5 to 12.5 mm.

15. A process for drying a suspension of a finely divided particulate solid material in an aqueous or non-aqueous medium to thereby produce a substantially dry product, comprising the steps of:

(a) introducing a said suspension having a solids content in excess of about 50% by weight based on the weight of the suspension into a grinding chamber containing a bed of particulate grinding media disposed upon a perforated base having an outer annular perforated area and a central imperforate area;

(b) agitating the grinding media in the grinding chamber by rotating an impeller therein provided with impeller bars the distal ends of which are spaced from the internal walls of the said chamber; and (c) introducing an upflow of heated gas through said perforate base of the grinding chamber such that it passes through the bed of the grinding media, the said disposition of said imperforate and perforate portions of said base causing said gas to flow preferentially through the annular region abounding the walls of the grinding chamber; and the substantially dry product being entrained by the gas and conveyed out of the grinding chamber.

16. A process in accordance with claim 15, wherein said grinding media comprises particles having a diameter in the range of 0.5 to 12.5 mm.

17. A process for drying a suspension of a finely divided particulate solid material in an aqueous or non-aqueous medium to thereby produce a substantially dry product, comprising the steps of:

(a) introducing the suspension into a grinding chamber containing a bed of particulate grinding media comprising particles having a diameter in the range of 0.5 to 12.5 mm. disposed upon a perforated base having an outer annular perforated area and a central imperforate area;

(b) agitating the grinding media in the grinding chamber by rotating an impeller therein provided with impeller bars the distal ends of which are spaced from the internal walls of the said chamber; and (c) introducing an upflow of heated gas through said perforate base of the grinding chamber such that it passes through the bed of the grinding media, the said disposition of said imperforate and perforate portions of said base causing said gas to flow preferentially through the annular region abounding the walls of the grinding chamber; and the substantially dry product being entrained by the gas and conveyed out of the grinding chamber.

* * * * *